US006375007B1

(12) United States Patent
Huang

(10) Patent No.: US 6,375,007 B1
(45) Date of Patent: Apr. 23, 2002

(54) TOOL BOX

(76) Inventor: Chao-Yang Huang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/815,582

(22) Filed: Mar. 21, 2001

(51) Int. Cl.[7] ..... B65D 85/28
(52) U.S. Cl. ..... 206/373; 206/378; 220/840
(58) Field of Search ..... 206/349, 372–379; 211/70.6; 312/902; 220/836, 840, 842

(56) References Cited

U.S. PATENT DOCUMENTS 5,535,882 A * 7/1996 Liu ..... 206/377
5,570,784 A * 11/1996 Sidabras et al. ..... 206/378
5,826,719 A * 10/1998 Chen ..... 206/373
5,839,579 A * 11/1998 Lee ..... 206/378
6,070,732 A * 6/2000 Chen ..... 206/373
6,109,437 A * 8/2000 Chao ..... 206/378

* cited by examiner

*Primary Examiner*—Luan K. Bui

(57) ABSTRACT

A tool box has an upper casing and a lower casing. The upper casing has a first outer layer and a first inner layer. The lower casing has a second outer later and a second inner layer. The first inner layer has a plurality of first click blocks, a plurality of first grooves, a first pivot seat, a first pivot mount, a first protrusion, and a first blind hole. The second inner layer has a plurality of second click blocks, a plurality of second grooves, a second pivot seat, a second pivot mount, a second protrusion, and a second blind hole. The first pivot mount engages with the second pivot seat. The first pivot seat engages with the second pivot mount.

1 Claim, 5 Drawing Sheets

TOOL BOX

BACKGROUND OF THE INVENTION

The present invention relates to a tool box. More particularly, the present invention relates to a tool box which is easily detached.

Referring to FIGS. 1 and 2, a conventional tool box has an upper casing 10 and a lower casing 20. The upper casing 10 has a first outer layer 101 and a first inner layer 102. The first inner layer 102 has two pivot seats 11. Each of the pivot seats 11 has a recess hole 12. The lower casing 20 has a second outer layer 201 and a second inner layer 202. The second inner layer 202 has two pivot mounts 21. Each of the pivot mounts 21 has a shaft 22 inserted in the corresponding recess hole 12 of the pivot seat 11. Once the first inner layer 102 engages with the second inner layer 202, the first inner layer 102 cannot be detached from the second inner layer 202.

SUMMARY OF THE INVENTION

An object of the present invention is to provide a tool box which has an upper casing and a lower casing to be detached easily.

Accordingly, a tool box comprises an upper casing and a lower casing. The upper casing has a first outer layer and-a first inner layer. The lower casing has a second outer layer and a second inner layer. The first inner layer has a plurality of first click blocks, a plurality of first grooves, a first pivot seat, a first pivot mount, a first protrusion, and a first blind hole. The second inner layer has a plurality of second click blocks, a plurality of second grooves, a second pivot seat, a second pivot mount, a second protrusion, and a second blind hole. The first pivot mount matches the second pivot seat. The first pivot seat matches the second pivot mount. The first pivot seat has a first recess hole. The second pivot seat has a second recess hole. The first pivot mount has a first packing ring and a first click column inserted in the second recess hole of the second pivot seat, The second pivot mount has a second packing ring and a second click column inserted in the first recess hole of the first pivot seat.

DETAILED DESCRIPTION OF THE INVENTION

Figure 1:
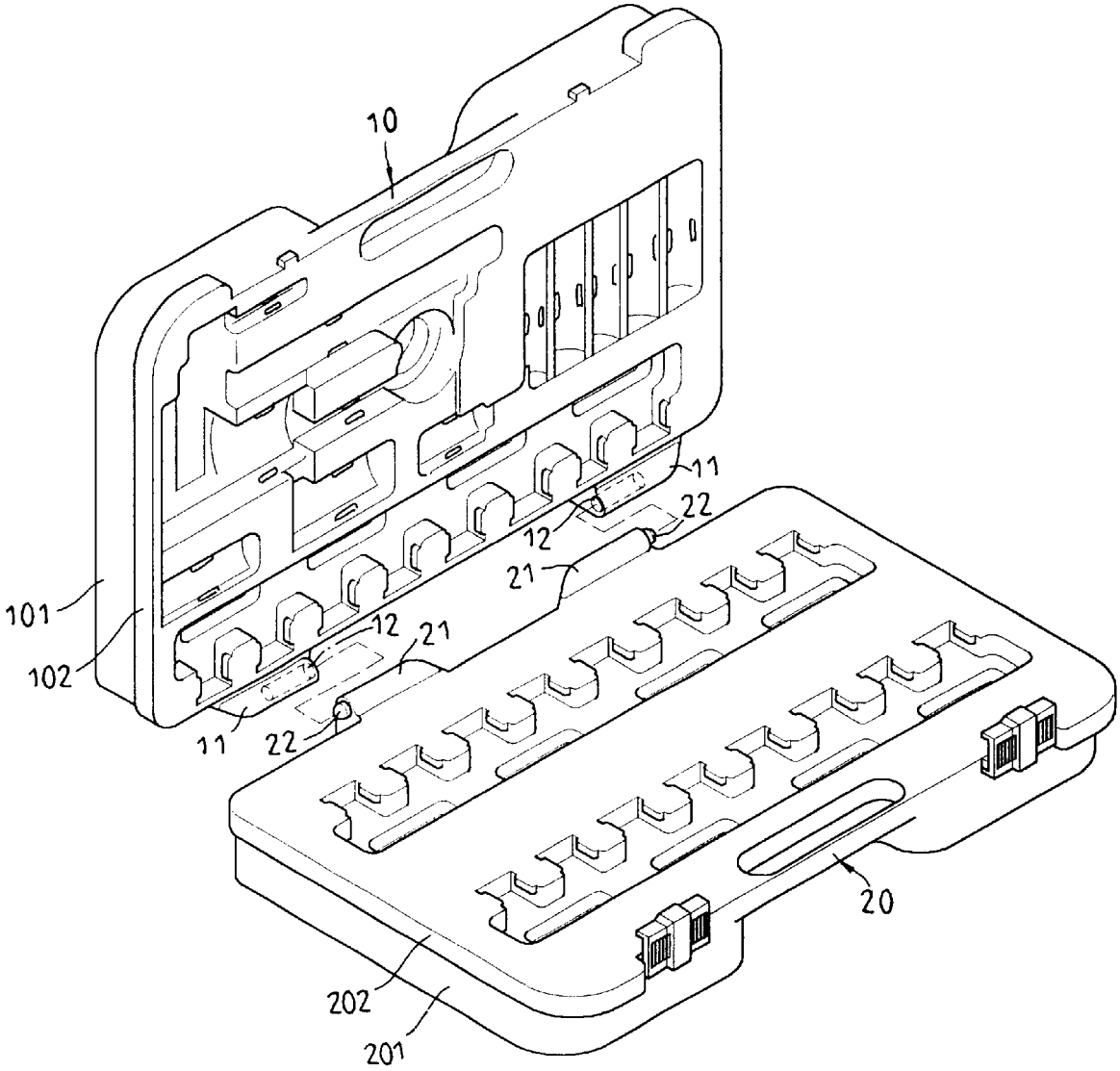
F I G. 1 PRIOR ART
FIG. 1 is a perspective exploded view of a tool box of the prior Art.
Figure 2:
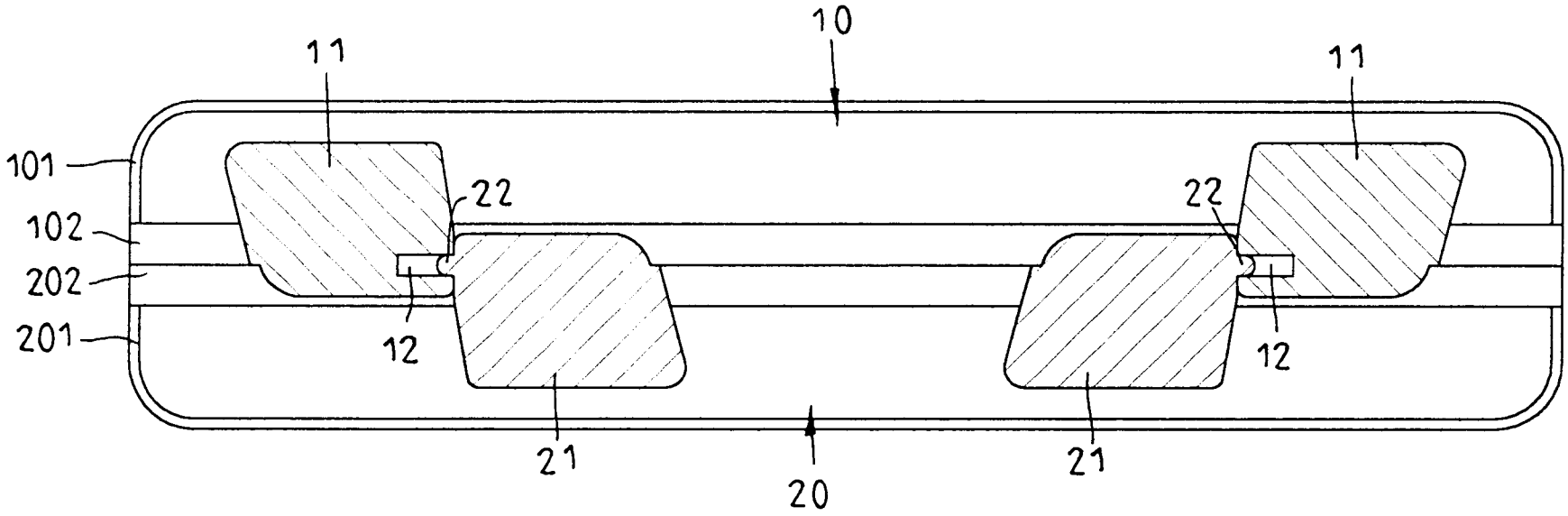
FIG. 2 PRIOR ART
FIG. 2 is a sectional assembly view of a tool box of the prior art.
Figure 3:
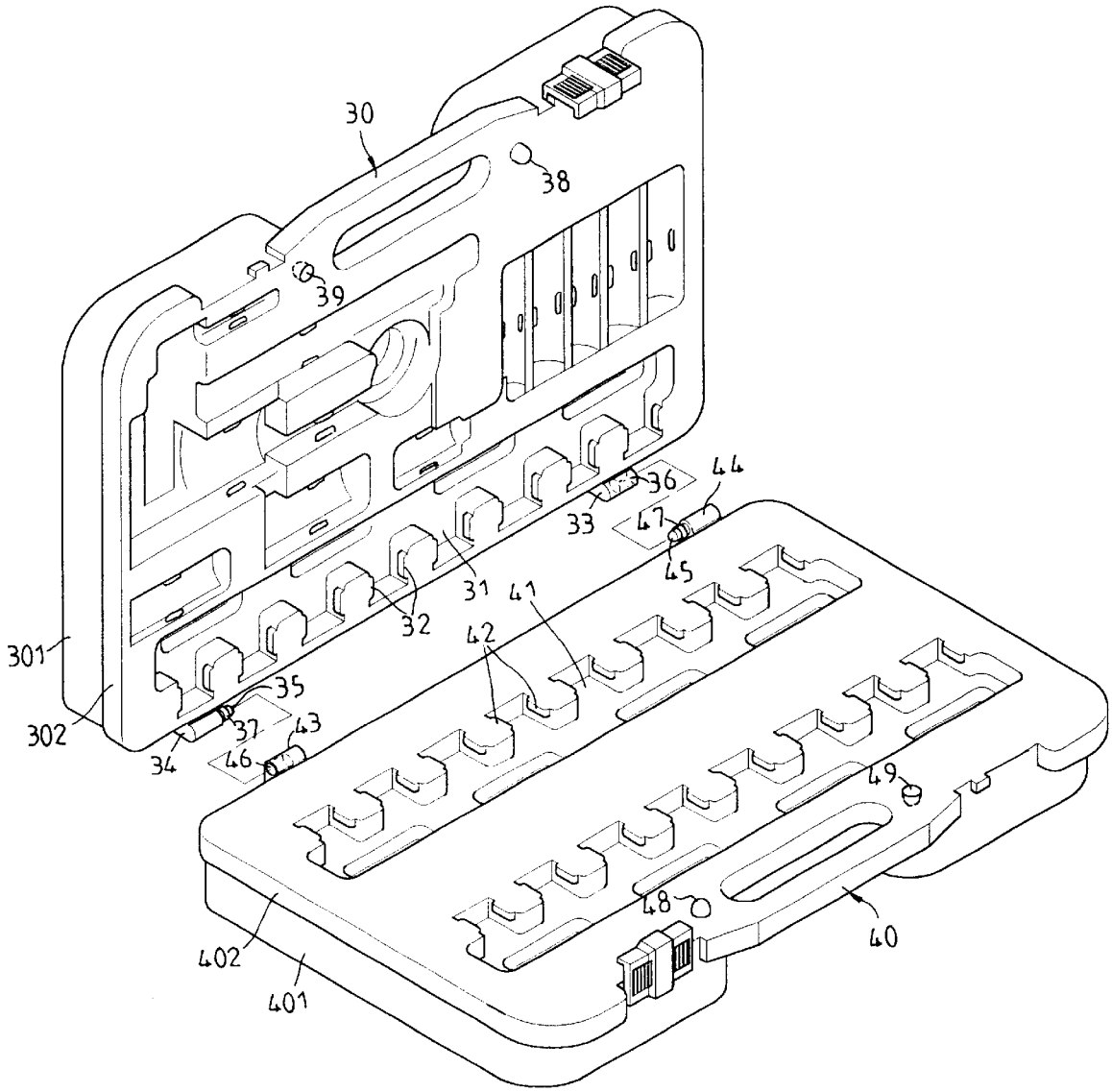
FIG. 3 is a perspective exploded view of a tool box of a preferred embodiment in accordance with the present invention.
Figure 4:
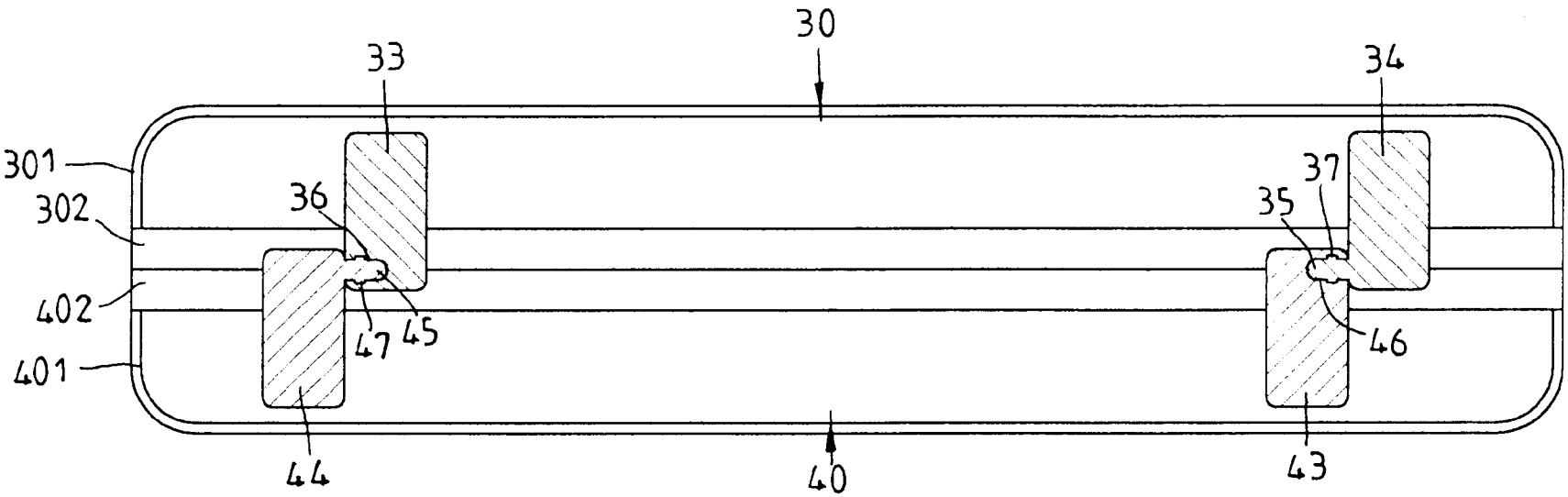
FIG. 4 is a sectional assembly view of a tool box of a preferred embodiment in accordance with the present invention.
Figure 5:
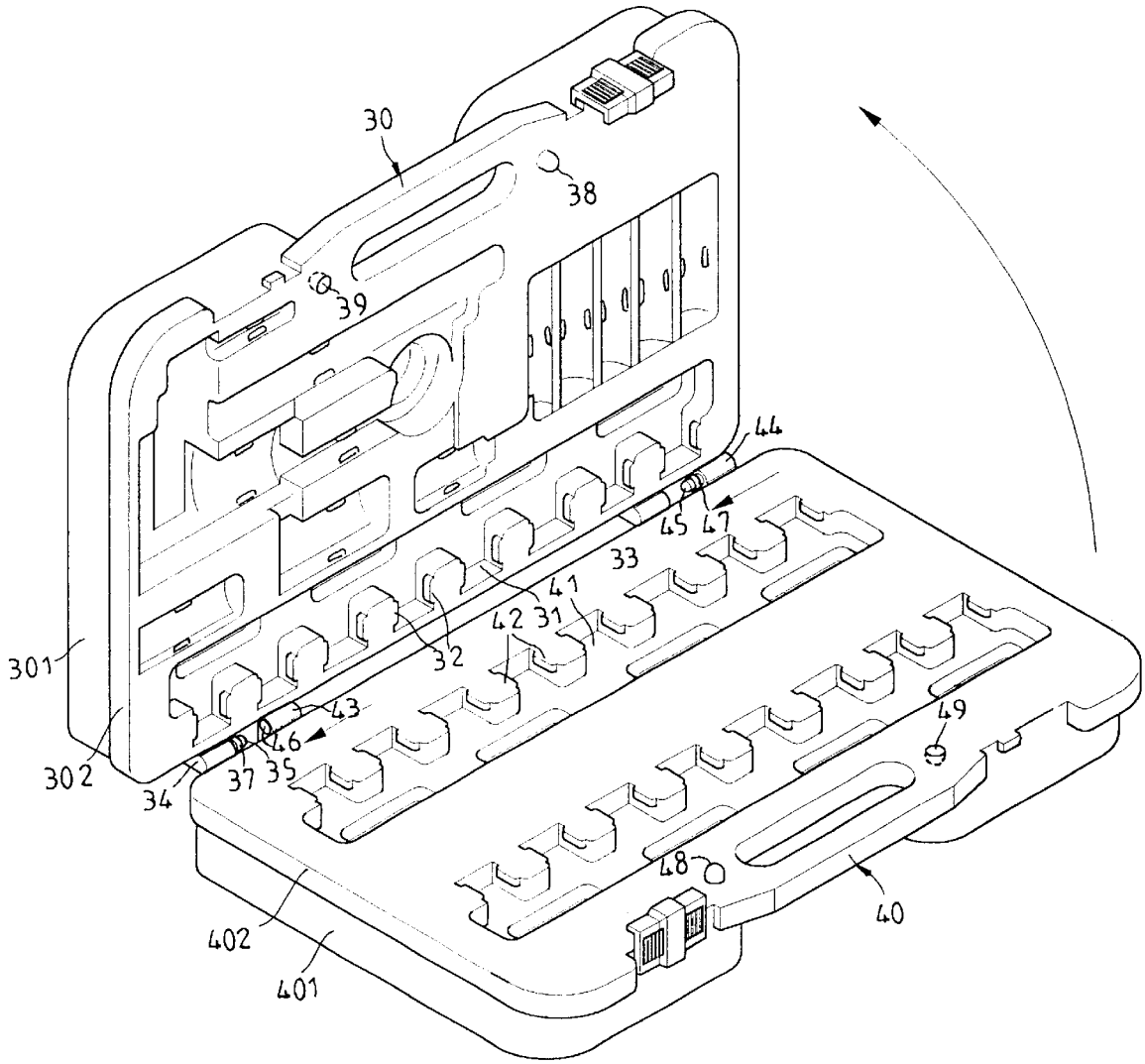
FIG. 5 is a perspective assembly view of a tool box, of a preferred embodiment in accordance With the present invention.

Referring to FIGS. 3 to 5, a tool box comprises an upper casing 30 and a lower casing 40. The upper casing 30 has X first outer layer 301 and a first inner layer 302. The lower casing 40 has a second outer layer 401 and a second inner layer 402.

The first inner layer 302 has a plurality of first click blocks 32, a plurality of first grooves 31, a first pivot seat 33, a first pivot mount 34, a first protrusion 38, and a first blind hole 39.

The second inner layer 402 has a plurality of second click blocks 42, a plurality of second grooves 41, a second pivot seat 43, a second pivot mount 44, a second protrusion 48, and a second blind hole 49.

The first pivot mount 34 matches the second pivot seat 43.

The first pivot seat 33 matches the second pivot mount 44.

The first pivot seat 33 has a first recess hole 36.

The second pivot seat 43 has a second recess hole 46.

The first pivot mount 34 has a first packing ring 37 and a first click column 35 inserted in the second recess hole 46 of the second pivot seat 43.

The second pivot mount 44 has a second packing ring 47 and a second click column 45 inserted in the first recess hole 36 of the first pivot seat 33.

The first protrusion 38 is inserted in the second blind hole 40.

The second protrusion 48 is inserted in the first blind hole 39.

The structure of the first outer layer 301 is the same as the structure of the second outer layer 401.

Referring to FIG. 5 again, the first protrusion 38 disengages from the second blind hole 49 and the second protrusion 48 disengages from the first blind hole 39. Then the first packing ring 37 and the first click column 35 disengage from the second recess hole 46 of the second pivot seat 43. The second packing ring 47 and the second click column 45 disengage from the first recess hole 36 of the first pivot seat 33.

The invention is not limited to the above embodiment but various modification thereof may be made. Further, various changes in form and detail may be made without departing from the scope of the invention.

I claim:

1. A tool box comprises:

an upper casing and a lower casing, the upper casing having a first outer layer and a first inner layer, the lower casing having a second outer layer and a second inner layer, the first inner layer having a plurality of first click blocks, a plurality of first grooves, a first pivot seat, a first pivot mount, a first protrusion, and a first blind hole, the second inner layer having a plurality of second click blocks, a plurality of second grooves, a second pivot seat, a second pivot mount, a second protrusion, and a second blind hole, the first pivot mount matching the second pivot seat, the first pivot seat matching the second pivot mount, the first pivot seat having a first recess hole, the second pivot seat having a second recess hole, the first pivot mount having a first packing ring and a first click column inserted in the second recess hole of the second pivot seat, and the second pivot mount having a second packing ring and a second click column inserted in the first recess hole of the first pivot seat.

* * * * *